United States Patent [19]

Rambausek

[11] 4,183,296

[45] Jan. 15, 1980

[54] DRIVE SYSTEM FOR SHEET-FED ROTARY PRINTING PRESSES WITH TANDEM-MOUNTED PRINTING UNITS

[75] Inventor: Hugo Rambausek, Wiesloch, Fed. Rep. of Germany

[73] Assignee: Heidelberger Druckmaschinen Aktiengesellschaft, Heidelberg, Fed. Rep. of Germany

[21] Appl. No.: 656,276

[22] Filed: Feb. 9, 1976

Related U.S. Application Data

[63] Continuation of Ser. No. 485,716, Jul. 3, 1974, abandoned.

[30] Foreign Application Priority Data

Jul. 5, 1973 [DE] Fed. Rep. of Germany ..... 2334177

[51] Int. Cl.[2] ..... B41F 5/06

[52] U.S. Cl. ..... 101/181; 101/183

[58] Field of Search ..... 101/135, 136, 151, 152, 101/180, 181, 183, 216; 74/665 GB

[56] References Cited

U.S. PATENT DOCUMENTS

| | | | |
|---|---|---|---|
| 1,430,274 | 9/1922 | Alger | 74/420 |
| 1,984,958 | 12/1934 | Barske | 74/665 GB |
| 2,707,914 | 5/1955 | Harrold | 101/183 |
| 3,084,621 | 4/1963 | Guastavino | 101/181 |
| 3,152,542 | 10/1964 | Chambon | 101/181 |
| 3,221,651 | 12/1965 | Tagliasacchi | 101/183 |
| 3,264,983 | 8/1966 | Lewis et al. | 101/181 |
| 3,358,595 | 12/1967 | Lindemann | 101/183 |
| 3,440,900 | 4/1969 | Neal | 101/183 X |
| 3,580,350 | 5/1971 | Arkus-Duntov | 74/665 GB |
| 3,732,815 | 5/1973 | Greiner et al. | 101/180 |

FOREIGN PATENT DOCUMENTS

| | | | |
|---|---|---|---|
| 1237140 | 3/1967 | Fed. Rep. of Germany | 101/183 |

*Primary Examiner*—Louis G. Mancene
*Assistant Examiner*—Paul J. Hirsch
*Attorney, Agent, or Firm*—Herbert L. Lerner

[57] ABSTRACT

Drive system for a sheet-fed rotary printing press with tandem-mounted printing units that are driven by a common motor through a main drive shaft and a closed gear train, at least two power input locations being provided in the gear train so as to form a closed power circuit, including at least one secondary power circuit formed in the first-mentioned power circuit, the secondary power circuit having a slip clutch connected therein, direction of power flow in said secondary power circuit being predetermined by the slip clutch.

6 Claims, 4 Drawing Figures

Fig. 1
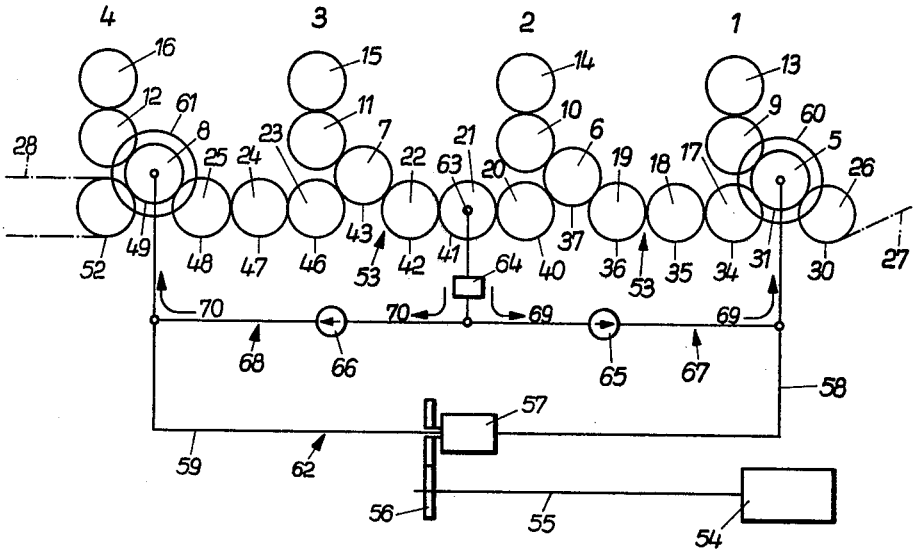
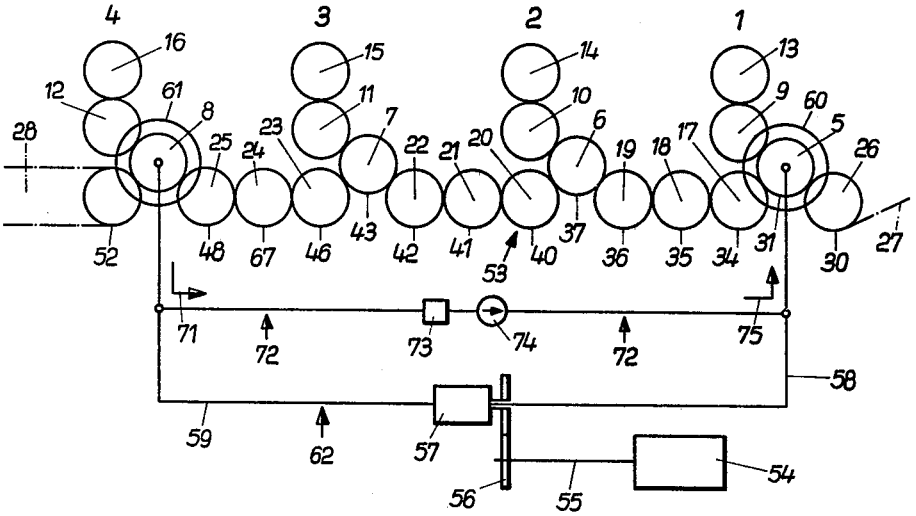
Fig. 2

Fig. 3
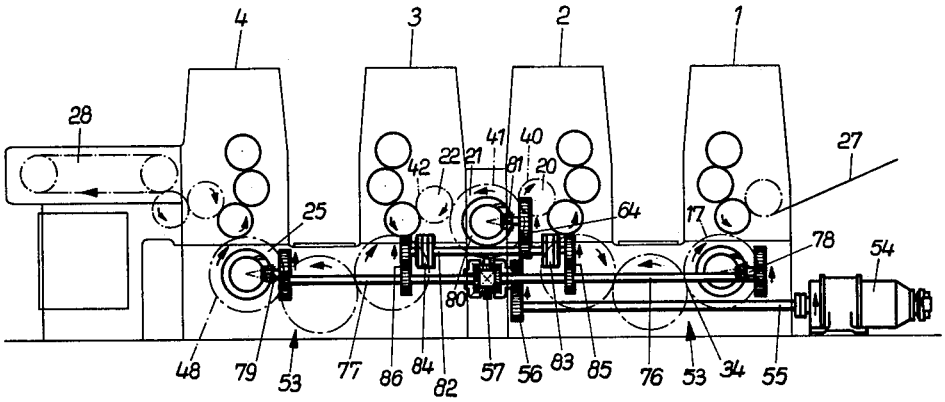
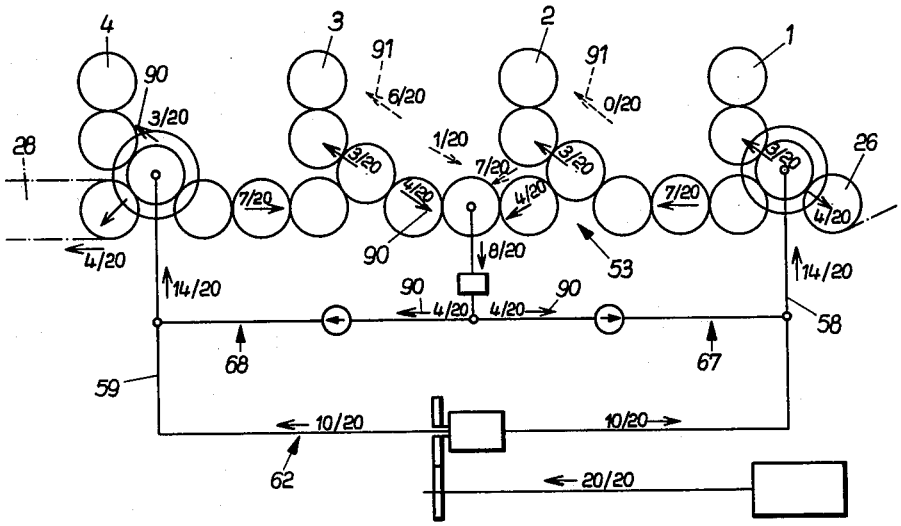
Fig. 4

DRIVE SYSTEM FOR SHEET-FED ROTARY PRINTING PRESSES WITH TANDEM-MOUNTED PRINTING UNITS part of the gear train cannot be attained by a selected power branching or distribution alone.

An object of the invention is to provide a drive system for sheet-fed rotary printing presses with tandem-mounted printing units of the foregoing type wherein a from the following description when read in connection with the accompanying drawing, in which:

FIG. 1 is a schematic view of the drive system of a four-color sheet-fed rotary printing press having a power circuit which includes two secondary power circuits;

FIG. 2 is a schematic view of the drive system of a four-color sheet-fed rotary printing press having a power circuit with one secondary power circuit;

FIG. 3 is a diagrammatic view of the structure of the drive of the four-color sheet-fed rotary printing press with two secondary power circuits shown in FIG. 1; and FIG. 4 is another view of FIG. 1 showing the power flow in the drive system thereof for varying power input to the printing units 2 and 3.

Referring now to the drawing and first, particularly, to FIG. 1 thereof, there are shown printing units 1 to 4 with respective impression cylinders 5 to 8, respective rubber or blanket cylinders 9 to 12, and respective plate cylinders 13 to 16 assembled in tandem to form a four-color sheet-fed rotary printing press. Respective trains of three transfers cylinders 17 to 19, 20 to 22 and 23 to 25 connect the individual printing units one to another and ensure the advance of the imprinted sheet. A feed cylinder 26 transfers an unprinted sheet from a conventional sheet-feeder 27, which is not shown in detail, to the first impression cylinder 5. A conventional endless chain sheet delivery device 28 accepts the fourfold imprinted sheet from the impression cylinder 8 of the last printing unit 4. Respective helical spur gears are mounted on the spindles of the impression cylinders 5 to 8, the feed cylinder 26 and the transfer cylinders 17 to 25 as well as on the spindle of the endless chain sheet delivery device 28 located next to the impression cylinder 8. Beginning with the spur gear 30 for the feed cylinder 26, and ending with the spur gear 52 for the endless chain sheet delivery device 28, the resulting closed gear train 53 is formed of spur gears 30, 31, 34, 35, 36, 37, 40, 41, 42, 43, 46, 47, 48, 49 and 52. All of the spur gears have like dimensions.

The printing units 1 to 4, the sheet feeding and delivery devices of which are not shown in detail in FIG. 1, consume power which is suppled by a motor 54, such as an electric motor, for example. The power delivered from the motor 54 is transmitted by a main drive shaft 55 and a pair of spur gears 56 to a branching differential 57 whereat a respective half thereof is distributed to each of two drive paths or lines 58 and 59 that are formed by conventional power transmitting means such as gears, shafts or any other power or torque transmitting machine elements. The drive path 58 terminates at a power input location 60 of the gear train 53 in the printing unit 1, and the drive path 59 at a power input location 61 in the printing unit 4. The drive paths 58 and 59 form, together with the gear train 53, a closed power circuit 62.

When there is a symmetrical load distribution, and in the absence of the hereinafter described inventive device of this application, the spur gears 40, 41 and 42 in this power circuit 62 are fully relieved of any load. Slight deviations in the power demand of the individual printing units 1 to 4 disturb the equilibrium. A consequence thereof is that the spur gears 40, 41 and 42 are at one time driven by the spur gear 37 of the printing unit 2 and at another time by the spur gear 43 of the printing unit 3 which causes a changeover in the flanks of the teeth of the gears and, thereby, transmission errors between the printing units 1 and 2, on the one hand, and the printing units 3 and 4, on the other hand.

To prevent such transmission errors, the spindle of the centrally-located transfer cylinder 21 provides a power take-off location 63. The just-mentioned spindle of the cylinder 21 is connected to a step-up or speed-up or speed-increasing transmission 64 having a transmission ratio such that the rotary speed at the output or driven side thereof is 5% greater than that of the transfer cylinder 21. Behind or at the output side of the speed-up transmission 64 the power taken off the spindle of the transfer cylinder 21 branches off in two equal components, each leading to a respective slip clutch 65, 66. From there, the respective component of power is transmitted with only slight losses from the slip clutch 65 to the drive path or line of shafts 58 and from the slip clutch 66 to the drive path 59.

Within the power circuit 62 proper, which is formed of the components 58, 53 and 59, two secondary power circuits 67 and 68 are thus formed with the aid of the power take-off location 63, the speed-up transmission 64, the two slip clutches 65 and 66 as well as their respective transmission components. The power flow direction in both secondary power circuits 67 and 68 is indicated by arrows 69 and 70 respectively. The secondary power circuit 68 produces in the gear train section formed of the gears 49, 48, 47, 46, 43, 42 and 41, a prestressing preloading force of such magnitude and direction that varying power inputs to the printing units 1 to 4 can produce no changeover of the driving flanks of the spur gears of the gear train 53.

The schematically illustrated four-color sheet-fed rotary printing press of FIG. 2 is constructed exactly the same as that of FIG. 1 as hereinbefore described. The drive train and the power circuit 62 are also identical. The motor 54 delivers its power through the main drive shaft 55 and the spur gear pair 56 to the branching differential 57. The power is there distributed equally to the drive paths 58 and 59, respectively, and fed through power input locations 60 and 61 to the gear train 53 and thereby to the press.

In the embodiment of FIG. 2, however, the means for producing a prestressing or preloading force in the gear train 53 is of different construction than that for the embodiment of the invention shown in FIG. 1. As indicated by an arrow 71 in FIG. 2, power is drawn from a secondary power circuit 72 and the drive path 59, and is returned to the drive path 58, through a speed-up transmission 73, a slip clutch 74 as well as the respective transmission components, with only slight losses. An arrow 75 indicates the direction of power flow at the junction of the secondary power circuit 72 with the drive path or line of shafts 58. The single secondary power circuit 72 extends virtually parallel to part of the power circuit 62 and produces a prestressing or preloading force of selective magnitude in the entire gear train 53.

FIG. 3 shows diagrammatically a four-color sheet-fed rotary printing press structure similar to the schematic representation shown in FIG. 1, having two secondary power circuits. The drive for the printing units 1 to 4 in FIG. 3 is effected, as in FIG. 1, by the gear train 53. However, in the embodiment of FIG. 3, all of the transfer cylinders with the exception of the transfer cylinders 20 and 22 are double the diameter of the cylinders of the printing units proper.

The power that is made available by the electric motor 54 in FIG. 3 is transmitted through the main

DRIVE SYSTEM FOR SHEET-FED ROTARY PRINTING PRESSES WITH TANDEM-MOUNTED PRINTING UNITS

This is a continuation of application Ser. No. 485,716, filed July 3, 1974 now abandoned.

The invention relates to a drive system for sheet-fed rotary printing presses with tandem-mounted printing units and more particularly, wherein the printing units are driven by a common motor through a main drive shaft and by means of a closed gear train, at least two power input locations being provided in the gear train so as to form a closed power circuit.

There has been known heretofore from German Pat. No. 1213428 to provide a drive for sheet-fed rotary printing presses with tandem-mounted printing units which has a worm gear transmission through which all of the power generated by the motor is fed to a gear mounted on the spindle of the impression cylinder of the first printing unit and from there further transmitted proportionately over a gear train of spur gears to the succeeding printing units inclusive of the transfer cylinders. The loading of the gears varies in accordance with the relative positions thereof in the gear train. The gears that are mounted in cantilever on the the spindles of the cylinders accordingly exert forces on the cylinder spindles which manifest themselves in producing deformations in the spindles. Such deformations can cause printing problems and difficulties.

It is furthermore been known heretofore from German Pat. No. 1 237 140 to provide a drive of a multicolor printing press with tandem-mounted printing units which in addition to the gear train, also includes a longitudinal shaft driven by the motor, the power from which branches off and is fed to the gear train at two locations thereof. In this way, it is possible to relieve the gear train of stress or load to a marked extent and thereby reduce the hereinabove-mentioned deformations to an acceptable value.

It has been found from experience, however, that the power or torque demanded by the printing units from the main drive is not constant as to time but rather varies during a printing cycle, caused mainly, for example, by reactions of non-uniformly displaced mechanisms for the gripper bite. The slightly loaded gears can be fully relieved of their load under certain circumstances. It is even possible that the loading direction can be reversed, whereby transmission or transfer errors may occur due to the unavoidable backlash which arises in the changeover from the driving to the driven flank of the respective gear tooth.

To prevent the changeover of the drive flanks of the gears in the gear train, there is provided in a drive system heretofore known from the aforementioned German Pat. No. 1 237 140, a branching differential in the drive train which affords a division of the torque to the individual drive groups in a predetermined ratio. This measure by itself would be insufficient, however, if the power requirement or demand of the individual printing units varies in the ratio thereof one to the other, since the division of the power effected by the differentials remains constant. A change in direction of power flow between individual printing units is consequently possible and, thereby, a tooth flank changeover with its undesirable consequences may result. A continuously effective preloading or prestressing force in the critical part of the gear train cannot be attained by a selected power branching or distribution alone.

An object of the invention is to provide a drive system for sheet-fed rotary printing presses with tandem-mounted printing units of the foregoing type wherein a preloading or prestressing force of such magnitude and direction is produced in the entire gear train thereof or in a predetermined part thereof that, in spite of different power consumptions by the individual printing units, no changeover of the driving flanks of the gear teeth occurs.

With the foregoing and other objects in view, there is provided in accordance with the invention, a drive system for a sheet-fed rotary printing press with tandem-mounted printing units that are driven by a common motor through a main drive shaft and a closed gear train, at least two power input locations being provided in the gear train so as to form a closed power circuit, comprising at least one secondary power circuit formed in the first-mentioned power circuit, the secondary power circuit having a slip clutch connected therein, direction of power flow in the secondary power circuit being predetermined by the slip clutch.

The secondary power circuit continuously draws a quite specific predetermined amount of power from the drive train at one or more locations thereof, the power being then returned with least possible loss at one or more other locations. The slip clutch may be, for example, a combination electric generator-electric motor or may be formed of one or more hydrodynamic couplings or clutches. An advantage of the hydrodynamic clutch is that the torque consumption thereof increases with the square or second power of the rotary speed whereby a congruence exists between the torque consumption and the inertial forces of the non-uniformly displaced transmission components, the inertial forces also increasing with the square or second power of the rotary speed. The direction of power flow is determined by a given slippage, for example 5%, in order to keep the losses small.

Independently of the respective power demands or requirements of the individual printing units, the construction of the clutch provides for a rather specific power magnitude which is dependent only on the rotary speed. The power transverses, in a manner of speaking, in the circuit, one or more parts of the drive system, and thus forms, so to speak, one or more secondary power circuits, in accordance with other features of the invention. Each secondary power circuit produces, therefore, in the part of the gear train upon which it acts, a preloading or prestressing force that is relatively accurately determinable with respect to direction and magnitude thereof and that prevents raising of the teeth flanks in the critical part of the gear train. This prestressing or preloading force is independent of elasticity and therefore does not vary with wear, for example as the flanks of the gear teeth.

Other features which are considered as characteristic for the invention are set forth in the appended claims.

Although the invention is illustrated and described herein as drive system for sheet-fed rotary printing presses with tandem-mounted printing units, it is nevertheless not intended to be limited to the detail; shown, since various modifications may be made therein without departing from the spirit of the invention and within the scope and range of equivalents of the claims.

The invention, however, together with additional objects and advantages thereof will be best understood from the following description when read in connection with the accompanying drawing, in which:

FIG. 1 is a schematic view of the drive system of a four-color sheet-fed rotary printing press having a power circuit which includes two secondary power circuits;

FIG. 2 is a schematic view of the drive system of a four-color sheet-fed rotary printing press having a power circuit with one secondary power circuit;

FIG. 3 is a diagrammatic view of the structure of the drive of the four-color sheet-fed rotary printing press with two secondary power circuits shown in FIG. 1; and FIG. 4 is another view of FIG. 1 showing the power flow in the drive system thereof for varying power input to the printing units 2 and 3.

Referring now to the drawing and first, particularly, to FIG. 1 thereof, there are shown printing units 1 to 4 with respective impression cylinders 5 to 8, respective rubber or blanket cylinders 9 to 12, and respective plate cylinders 13 to 16 assembled in tandem to form a four-color sheet-fed rotary printing press. Respective trains of three transfers cylinders 17 to 19, 20 to 22 and 23 to 25 connect the individual printing units one to another and ensure the advance of the imprinted sheet. A feed cylinder 26 transfers an unprinted sheet from a conventional sheet-feeder 27, which is not shown in detail, to the first impression cylinder 5. A conventional endless chain sheet delivery device 28 accepts the fourfold imprinted sheet from the impression cylinder 8 of the last printing unit 4. Respective helical spur gears are mounted on the spindles of the impression cylinders 5 to 8, the feed cylinder 26 and the transfer cylinders 17 to 25 as well as on the spindle of the endless chain sheet delivery device 28 located next to the impression cylinder 8. Beginning with the spur gear 30 for the feed cylinder 26, and ending with the spur gear 52 for the endless chain sheet delivery device 28, the resulting closed gear train 53 is formed of spur gears 30, 31, 34, 35, 36, 37, 40, 41, 42, 43, 46, 47, 48, 49 and 52. All of the spur gears have like dimensions.

The printing units 1 to 4, the sheet feeding and delivery devices of which are not shown in detail in FIG. 1, consume power which is suppled by a motor 54, such as an electric motor, for example. The power delivered from the motor 54 is transmitted by a main drive shaft 55 and a pair of spur gears 56 to a branching differential 57 whereat a respective half thereof is distributed to each of two drive paths or lines 58 and 59 that are formed by conventional power transmitting means such as gears, shafts or any other power or torque transmitting machine elements. The drive path 58 terminates at a power input location 60 of the gear train 53 in the printing unit 1, and the drive path 59 at a power input location 61 in the printing unit 4. The drive paths 58 and 59 form, together with the gear train 53, a closed power circuit 62.

When there is a symmetrical load distribution, and in the absence of the hereinafter described inventive device of this application, the spur gears 40, 41 and 42 in this power circuit 62 are fully relieved of any load. Slight deviations in the power demand of the individual printing units 1 to 4 disturb the equilibrium. A consequence thereof is that the spur gears 40, 41 and 42 are at one time driven by the spur gear 37 of the printing unit 2 and at another time by the spur gear 43 of the printing unit 3 which causes a changeover in the flanks of the teeth of the gears and, thereby, transmission errors between the printing units 1 and 2, on the one hand, and the printing units 3 and 4, on the other hand.

To prevent such transmission errors, the spindle of the centrally-located transfer cylinder 21 provides a power take-off location 63. The just-mentioned spindle of the cylinder 21 is connected to a step-up or speed-up or speed-increasing transmission 64 having a transmission ratio such that the rotary speed at the output or driven side thereof is 5% greater than that of the transfer cylinder 21. Behind or at the output side of the speed-up transmission 64 the power taken off the spindle of the transfer cylinder 21 branches off in two equal components, each leading to a respective slip clutch 65, 66. From there, the respective component of power is transmitted with only slight losses from the slip clutch 65 to the drive path or line of shafts 58 and from the slip clutch 66 to the drive path 59.

Within the power circuit 62 proper, which is formed of the components 58, 53 and 59, two secondary power circuits 67 and 68 are thus formed with the aid of the power take-off location 63, the speed-up transmission 64, the two slip clutches 65 and 66 as well as their respective transmission components. The power flow direction in both secondary power circuits 67 and 68 is indicated by arrows 69 and 70 respectively. The secondary power circuit 68 produces in the gear train section formed of the gears 49, 48, 47, 46, 43, 42 and 41, a prestressing preloading force of such magnitude and direction that varying power inputs to the printing units 1 to 4 can produce no changeover of the driving flanks of the spur gears of the gear train 53.

The schematically illustrated four-color sheet-fed rotary printing press of FIG. 2 is constructed exactly the same as that of FIG. 1 as hereinbefore described. The drive train and the power circuit 62 are also identical. The motor 54 delivers its power through the main drive shaft 55 and the spur gear pair 56 to the branching differential 57. The power is there distributed equally to the drive paths 58 and 59, respectively, and fed through power input locations 60 and 61 to the gear train 53 and thereby to the press.

In the embodiment of FIG. 2, however, the means for producing a prestressing or preloading force in the gear train 53 is of different construction than that for the embodiment of the invention shown in FIG. 1. As indicated by an arrow 71 in FIG. 2, power is drawn from a secondary power circuit 72 and the drive path 59, and is returned to the drive path 58, through a speed-up transmission 73, a slip clutch 74 as well as the respective transmission components, with only slight losses. An arrow 75 indicates the direction of power flow at the junction of the secondary power circuit 72 with the drive path or line of shafts 58. The single secondary power circuit 72 extends virtually parallel to part of the power circuit 62 and produces a prestressing or preloading force of selective magnitude in the entire gear train 53.

FIG. 3 shows diagrammatically a four-color sheet-fed rotary printing press structure similar to the schematic representation shown in FIG. 1, having two secondary power circuits. The drive for the printing units 1 to 4 in FIG. 3 is effected, as in FIG. 1, by the gear train 53. However, in the embodiment of FIG. 3, all of the transfer cylinders with the exception of the transfer cylinders 20 and 22 are double the diameter of the cylinders of the printing units proper.

The power that is made available by the electric motor 54 in FIG. 3 is transmitted through the main